US010918128B2

(12) United States Patent
Jordil et al.

(10) Patent No.: US 10,918,128 B2
(45) **Date of Patent: *Feb. 16, 2021**

(54) TUBE FOR A SMOKING ARTICLE

(71) Applicant: PHILIP MORRIS PRODUCTS S.A., Neuchatel (CH)

(72) Inventors: Yves Jordil, Lausanne (CH); Cecilia Lindholm Delaloye, Preverenges (CH); Emeric Grandjean, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 44 days.

This patent is subject to a terminal disclaimer.

(21) Appl. No.: 15/552,705

(22) PCT Filed: Mar. 17, 2016

(86) PCT No.: PCT/EP2016/055878

§ 371 (c)(1),
(2) Date: Aug. 22, 2017

(87) PCT Pub. No.: WO2016/146781

PCT Pub. Date: Sep. 22, 2016

(65) Prior Publication Data

US 2018/0042293 A1 Feb. 15, 2018

(30) Foreign Application Priority Data

Mar. 17, 2015 (EP) ..... 15159519

(51) Int. Cl.

| | |
|---|---|
| ***A24D 3/04*** | (2006.01) |
| ***A24D 1/04*** | (2006.01) |
| ***A24D 3/18*** | (2006.01) |

(52) U.S. Cl.

CPC ..... *A24D 1/045* (2013.01); *A24D 1/04* (2013.01); *A24D 3/041* (2013.01); *A24D 3/043* (2013.01); *A24D 3/18* (2013.01)

(58) Field of Classification Search

CPC ..... A24D 3/041; A24D 3/043; A24F 13/02; A24F 13/04; A24F 13/22

See application file for complete search history.

(56) References Cited

U.S. PATENT DOCUMENTS

| | | | |
|---|---|---|---|
| 1,581,451 | A | 10/1925 | Knapp |
| 1,862,679 | A | 6/1932 | Holsman |

(Continued)

FOREIGN PATENT DOCUMENTS

| | | |
|---|---|---|
| CN | 2251264 | 4/1997 |
| CN | 1187108 | 7/1998 |

(Continued)

OTHER PUBLICATIONS

Extended European Search Report for Application No. 15159519.6 dated Sep. 28, 2015 (5 pages).

(Continued)

*Primary Examiner* — Eric Yaary
(74) *Attorney, Agent, or Firm* — Mueting Raasch Group

(57) ABSTRACT

A tube (10) for temporary affixment to a mouthpiece of a smoking article (80), the tube (10) comprising an open upstream end, an open downstream end, an outer surface, and an inner surface defining a lumen for receiving the mouthpiece of the smoking article, the lumen extending from the open upstream end to the open downstream end; the tube further comprising a first ventilation zone (50) for providing ventilation into the lumen of the tube, the first ventilation zone comprising a first line of perforation holes (52) circumscribing the tube at a location at least 10 mm from the open downstream end of the tube.

10 Claims, 2 Drawing Sheets

(56) References Cited

U.S. PATENT DOCUMENTS

| | | | | |
|---|---|---|---|---|
| 2,718,889 | A | 11/1951 | Claussen | |
| 2,965,107 | A | 12/1960 | Lehv | |
| 3,260,266 | A | 7/1966 | Miller | |
| 3,977,416 | A | 8/1976 | Akiba | |
| 4,289,149 | A | 9/1981 | Kyriakou | |
| 4,532,943 | A * | 8/1985 | Nichols | A24D 3/041 131/198.1 |
| 4,766,911 | A * | 8/1988 | Oglesby | A24C 5/601 131/281 |
| 5,992,420 | A | 11/1999 | Moriyama | |
| 6,182,669 | B1 | 2/2001 | van Der Elst | |
| 10,426,192 | B2 | 10/2019 | Allerton | |
| 2002/0083952 | A1 | 7/2002 | Braun | |
| 2007/0261706 | A1 | 11/2007 | Banerjea | |
| 2008/0029111 | A1 | 2/2008 | Dube | |
| 2011/0180081 | A1 * | 7/2011 | Fiebelkorn | A24D 3/041 131/198.2 |
| 2011/0232663 | A1 | 9/2011 | Kadiric | |
| 2014/0202470 | A1 * | 7/2014 | Blick | A24D 3/041 131/77 |
| 2015/0034100 | A1 * | 2/2015 | Park | A24D 1/02 131/281 |
| 2015/0351451 | A1 * | 12/2015 | Kaljura | A24D 3/043 131/280 |

FOREIGN PATENT DOCUMENTS

| | | | | |
|---|---|---|---|---|
| CN | 2631238 | 8/2004 | | |
| CN | 1709169 | 12/2005 | | |
| CN | 201691051 | 1/2011 | | |
| CN | 103037720 | 4/2013 | | |
| DE | 20302406 | 4/2003 | | |
| DE | 69627212 | 2/2004 | | |
| GB | 294823 | 8/1928 | | |
| GB | 2210546 | 6/1989 | | |
| JP | S54-134681 | 9/1979 | | |
| JP | H02123896 | 10/1990 | | |
| JP | 2008-523800 | 7/2008 | | |
| JP | 2009-545324 | 12/2009 | | |
| JP | 2013-523101 | 6/2013 | | |
| WO | 2011/121328 | 10/2011 | | |
| WO | WO 2011/121325 | 10/2011 | | |
| WO | WO 2011/121326 | 10/2011 | | |
| WO | WO-2013083963 | A1 * 6/2013 | | A24F 13/02 |
| WO | WO 2013/104616 | 7/2013 | | |

OTHER PUBLICATIONS

PCT/EP2016/055878 International Search Report and Written Opinion dated Jun. 6, 2016 (9 pages).

Office Action issued in Russia for Application No. 2017134329 dated Apr. 30, 2019 (11 pages). English translation included.

Office Action issued in China for Application No. 201680008475.2 dated Oct. 31, 2019 (12 pages). English translation included.

Office Action issued in Japan for Application No. 2017-542410 dated Mar. 30, 2020 (10 pages). English translation included.

* cited by examiner

TUBE FOR A SMOKING ARTICLE

This application is a U.S. National Stage Application of International Application No. PCT/EP2016/055878, filed Mar. 17, 2016, which was published in English on Sep. 22, 2016, as International Publication No. WO 2016/146781 A1. International Application No. PCT/EP2016/055878 claims priority to European Application No. 15159519.6 filed Mar. 17, 2015.

The present invention relates to a tube for temporary affixment to a mouthpiece of a smoking article (for example cigarettes), and to a smoking article having such a tube affixed to it. The invention also relates to a container containing one or more such tubes.

Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

Generally, a consumer smokes a smoking article until the burning area of the tobacco rod reaches the edge of the tipping paper. This means that a small portion of the tobacco (where the tipping paper overlaps the tobacco rod) still remains unburnt and will continue to burn unless extinguished. Therefore, the consumer extinguishes the smoking article, typically by holding the filter and pressing the lit end of the smoking article against the base of an ashtray or other hard non-flammable surface. This disrupts the structure of the lit end and prevents oxygen reaching the burning tobacco, and burning usually stops rapidly. However, in the process of extinguishing the smoking article, the consumer's fingers may come into contact with, or close to, the lit end of the smoking article or old ash remaining in the ashtray.

Several solutions have therefore been proposed for extinguishing a smoking article in a safe, hygienic way. For example, it has been proposed to modify the burning characteristics of the paper surrounding the tobacco rod at or around its downstream end, so that the cigarette will effectively self-extinguish when the lit end reaches this modified section. However, in some circumstances, a consumer may wish to extinguish the cigarette before the lit end reaches the modified section of the wrapper, and thus need to extinguish the cigarette manually. Furthermore, the modified section may not always extinguish the lit end in a quick and reliably manner.

An alternative proposed solution is to provide a tube or sleeve that can slide over a smoking article and cover the lit end of the tobacco rod to extinguish the smoking article, after a consumer has finished smoking the smoking article. However, such tubes can hinder or undesirably affect the function of the smoking article during smoking.

It would therefore be desirable to provide a solution for extinguishing a smoking article in safe and hygienic way, without hindering or undesirably affecting the function of the smoking article during smoking.

According to a first aspect of the present invention there is provided a tube for temporary affixment to a mouthpiece of a smoking article, the tube comprising an open upstream end, an open downstream end, an outer surface, and an inner surface defining a lumen for receiving the mouthpiece of the smoking article, the lumen extending from the open upstream end to the open downstream end; the tube further comprising a first ventilation zone for providing ventilation into the lumen of the tube, the first ventilation zone comprising a first line of perforation holes circumscribing the tube at a location at least 10 mm from the open downstream end of the tube.

It is often desirable to ventilate a mouthpiece of a smoking article to dilute the mainstream smoke that a smoker receives. Ventilation of mainstream smoke can be achieved with one or more rows of perforations in the tipping paper about a location along the mouthpiece. Known extinguishing tubes could occlude such holes and thus eliminate the ventilation that the holes were intended to provide.

By providing a tube according to the first aspect of the present invention, a consumer can slide the tube over the mouthpiece during smoking and utilise the line of perforation holes on the tube to provide a desired level of ventilation, even if the tube is occluding existing perforation holes on the smoking article mouthpiece. This advantageously allows a consumer to use the tube as an extension of the mouthpiece during smoking, without hindering or undesirably affecting their smoking experience. The tube can then remain on the mouthpiece until the consumer chooses to extinguish the cigarette. The consumer can use the tube as an extinguishing aid, by sliding the tube upstream along the mouthpiece, such that the lit end of the smoking article resides in the lumen of the tube and is thereby extinguished. Accordingly, the tube of according to the first aspect of the present invention should be configured to slide over the entire length of a smoking article. That is, the tube should be configured to have an inner surface that does not inhibit or prevent the tube from passing over and around a a smoking article. In particular, the inner surface should be continuous, without any distinct steps that would prevent the tube from sliding over and along the entire length of a smoking article.

Furthermore, the tube in accordance with the first aspect of the invention provides a consumer with a novel way to create a mouth end cavity on a smoking article, or increase the length of an existing mouth end cavity on a smoking article, to customise their smoking experience.

The term "inner surface" is used throughout the specification to refer to the side of the tube that faces towards the lumen. Likewise, the term "outer surface" is used throughout the specification to refer to the side of the tube that faces towards the exterior of the tube.

The terms "upstream" and "downstream" refer to relative positions of elements of the smoking article or filter described in relation to the direction of mainstream smoke as it is drawn from the aerosol generating substrate and through the filter or mouthpiece. Mainstream smoke flows generally parallel to the length of the smoking article, in the longitudinal direction. The transverse direction of the smoking article is perpendicular to the longitudinal direction.

The term "temporary affixment to a mouthpiece of a smoking article" is used herein to refer to a tube that can slide over and engage with a smoking article mouthpiece to retain the tube relative to the mouthpiece, but which can also be selectively slid off and separated from the smoking article mouthpiece by a consumer.

Preferably, the first line of perforation holes of the first ventilation zone are provided at a location between 10 mm and 15 mm from the open downstream end of the tube.

Preferably, the first ventilation zone further comprises one or more additional lines of perforation holes circumscribing the tube at a location between 12 mm and 30 mm from the open downstream end of the tube. By providing one or more additional lines of perforation holes circumscribing the tube at a location between 12 mm and 30 mm from the open downstream end of the tube, a consumer can customise the level of ventilation that the tube contributes. For example, if the first ventilation zone consists of 3 lines of perforations, a consumer could locate the tube around the mouthpiece such that only the two most upstream lines of perforations are occluded by the outer surface of the smoking article mouthpiece. In such a configuration, the most downstream line of perforations can provide ventilation into a mouth end cavity that is defined by the downstream end portion of the tube. If a consumer wishes to change the level of ventilation at any point during their smoking experience, they could slide the tube downstream relative to the smoking article, such that one or more of the two most upstream perforation lines are no longer occluded by the smoking article mouthpiece, and therefore are capable of contributing to the ventilation into the mouth end cavity. This provides a consumer with the ability to customise the ventilation level, and consequently configure the smoking experience to their own particular preference.

Preferably, the tube further comprises a second ventilation zone for providing ventilation into the lumen of the tube, the second ventilation zone comprising a first line of perforation holes circumscribing the tube at a location between 10 mm and 15 mm from the open upstream end of the tube. By providing a second ventilation zone having a line of perforation holes circumscribing the tube at a location between 10 mm and 15 mm from the open upstream end of the tube, the tube is capable of providing ventilation, regardless of what orientation the consumer chooses to slide the tube over the smoking article mouthpiece.

Preferably, the second ventilation zone further comprises one or more additional lines of perforation holes circumscribing the tube at a location between 12 mm and 30 mm from the open upstream end of the tube. By providing one or more additional lines of perforation holes circumscribing the tube at a location between 12 mm and 30 mm from the open upstream end of the tube, a consumer can customise the level of ventilation that the tube contributes. For example, if the first ventilation zone consists of 3 lines of perforations, a consumer could locate the tube around the mouthpiece such that only the two most upstream lines of perforations are occluded by the outer surface of the smoking article mouthpiece. In such a configuration, the most downstream line of perforations can provide ventilation into a mouth end cavity at the downstream end portion of the tube. If a consumer wishes to change the level of ventilation at any point during their smoking experience, they can simply slide the tube relative to the smoking article, such that one or more of the two most upstream perforation lines are no longer occluded by the smoking article mouthpiece, and therefore are capable of contributing to the ventilation into the mouth end cavity. This provides a consumer with the ability to customise the ventilation level, and consequently configure the smoking experience to their own particular preference.

In embodiments where the tube further comprises a second ventilation zone comprising a first line of perforation holes, preferably, the first line of perforation holes of the first ventilation zone is configured to provide a different level of ventilation than the first line of perforation holes of the second ventilation zone. This can provide a consumer with a further means for customising their smoking experience, since they can obtain a different level of ventilation depending on the orientation that the consumer chooses to slide the tube over the smoking article mouthpiece.

Preferably, the outer surface of the tube, the inner surface of the tube, or both, are provided with one or more indicia, wherein each indicia is configured to indicate the location of a respective line of perforation holes on the tube. This can advantageously help a consumer to locate the tube around the mouthpiece of the smoking article at a location that will provide a desired level of ventilation.

Preferably, a flavour delivery mechanism is provided on the inner surface of the tube, the outer surface of the tube, or both. In some preferred embodiments, the tube comprises a flavour delivery mechanism on the inner surface of the tube configured to release a first flavourant, and a flavour delivery mechanism on the outer surface of the tube configured to release a second flavourant. Preferably, the first flavourant is different from the second flavourant. For example, the inner surface of the tube may be configured to release a first flavourant for flavouring the smoke produced by a smoking article, and the outer surface of the tube may be configured to release a second flavourant for flavouring a consumer's lips, for flavouring a consumer's fingers, or both.

In some preferred embodiments, the flavour delivery mechanism is provided on only a portion of the outer surface, a portion of the inner surface, or both. For example, in some preferred embodiments a flavour delivery mechanism is provided only at the upstream end of the tube. This can be advantageous if the flavourant is provided to mask or negate the smells created when a smoking article is extinguished. Alternatively or additionally, a flavour delivery mechanism may be provided only on the downstream end of the outer surface of the tube. This can be advantageous if the flavour delivery mechanism includes a flavourant for flavouring a consumer's lips.

Preferably, the flavour delivery mechanism is configured to release flavourant in response to one or more trigger events. Preferred trigger events include movement of the tube relative to the smoking article when the tube is affixed to the smoking article, the addition of moisture, a change of pH, a temperature increase, and combinations thereof.

A particularly preferred trigger event is movement of the tube relative to the smoking article when the tube is affixed to the smoking article. This could be by moving the tube laterally over the mouthpiece, by moving the tube rotationally around the mouthpiece, or both. However, in some particularly preferred embodiments, it is preferable for the flavourant to be released in response to rotational movement of the tube around the mouthpiece, since this can allow a consumer to choose precisely when the trigger mechanism is activated. An indicia may be provided on the outer surface of the tube for informing the consumer that rotational movement of the tube around the mouthpiece can release flavourant.

In some preferred embodiments, the flavour delivery mechanism comprises a plurality of frangible flavour containers provided on a surface of the tube, wherein the plurality of frangible flavour containers are adapted to be manually ruptured by a consumer during use, to release a flavour from within the containers. Where the frangible flavour containers are provided on the outer surface of the tube, the consumer can rupture the containers with their fingers, for example, to transfer flavour to their fingers. Alternatively or additionally, the frangible containers may be provided on the inner surface of the tube. In such embodiments, the consumer can rupture the frangible containers on the inner surface of the tube by moving the tube laterally over the mouthpiece, by moving the tube rotationally around the mouthpiece, or both.

The term "frangible flavourant containers" is used herein to mean any container which is suitable for housing a flavourant and which can be manually ruptured by a consumer. Preferably the frangible flavourant containers are frangible microcapsules. Therefore, further aspects of the invention may be described with reference to frangible microcapsules, although the skilled person will understand that such aspects are equally applicable when used with other forms of frangible flavourant container.

The term "flavourant" used throughout this specification, should be interpreted to include a gustatory sensation (taste), an olfactory sensation (smell), or both a gustatory sensation and an olfactory sensation. For example, the flavourant may impart a taste onto a consumer's fingers or into the mainstream smoke to enhance the mainstream smoke, or both. Alternatively or additionally, the flavourant may impart a fragrance onto a consumer's fingers, for example a fresh fragrance after smoking, or into the mainstream smoke, or both.

In one embodiment, the flavour delivery mechanism is configured to release flavourant in response to exposure to moisture from, for example, the smoke produced by the smoking article or the lips or mouth of a consumer. In another embodiment, heat from the lit end of the smoking article or from the user's mouth or lips may cause the flavour delivery mechanism is to release flavourant. In yet another embodiment, the flavour delivery mechanism is configured to release flavourant in response to a change in pH. The change in pH may occur when the flavour delivery mechanism is placed in an environment such as consumer's mouth.

Preferably, the flavourant is suitable for interacting with and modifying the characteristics of the smoking article and thus the smoke derived therefrom. For example, the flavourant may impart a flavour to enhance the taste of the mainstream smoke produced during smoking. In that case, when the flavourant is released, the consumer may experience a new smoking sensation due to the modified mainstream smoke.

Suitable flavourants or flavourings include, but are not limited to, menthol, mint, such as peppermint and spearmint, eucalyptus, sage, chocolate, liquorice, citrus and other fruit flavourants, gamma octalactone, vanillin, ethyl vanillin, breath freshener flavourants, spice flavourants such as cinnamon, methyl salicylate, linalool, bergamot oil, geranium oil, lemon oil, ginger oil, and tobacco flavourant. Other suitable flavourants may include flavourant compounds selected from the group consisting of an acid, an alcohol, an ester, an aldehyde, a ketone, a pyrazine, combinations or blends thereof and the like.

Preferably, the outer diameter of the tube at the open upstream end is at least about 90 percent of the outer diameter of the tube at the open downstream end, more preferably at least about 95 percent of the outer diameter of the tube at the open downstream end. In particularly preferred embodiments the outer surface of the tube is substantially cylindrical. That is, preferably the outer diameter of the tube at the open upstream end is substantially the same as the outer diameter of the tube at the open downstream end.

Preferably, the inner diameter of the tube at the open upstream end is at least about 90 percent of the inner diameter of the tube at the open downstream end, more preferably at least about 95 percent of the inner diameter of the tube at the open downstream end. In particularly preferred embodiments the inner surface of the tube is substantially cylindrical. This can ensure that the cross-section of the lumen in the tube remains substantially cylindrical, which can assist with affixment of the tube to the smoking article.

Preferably, the inner diameter of the tube at the open upstream end is at least about 90 percent of the outer diameter of the tube at the open upstream end, more preferably at least about 95 percent of the outer diameter of the tube at the open downstream end. This means that the tube can be affixed to the smoking article without greatly increasing the radial dimension or appearance of the smoking article.

Preferably, the inner diameter of the tube at the open downstream end is at least about 90 percent of the outer diameter of the tube at the open downstream end, more preferably at least about 95 percent of the outer diameter of the tube at the open downstream end. This means that the tube can be affixed to the smoking article without greatly increasing the radial dimension or appearance of the smoking article.

Preferably, the lumen is configured to receive the entire smoking article mouthpiece of the smoking article.

Preferably, the tube has a length of between about 30 millimetres and about 70 millimetres, more preferably between about 37 mm and about 60 mm. In some preferred embodiments, the tube has a length of about 45 mm. This can advantageously allow the tube to be disposed around at least a substantial portion of the mouthpiece of a smoking article during smoking, whilst still allowing the first line of perforation holes of the first ventilation zone to provide ventilation into a mouth end cavity that is at least in part defined by the tube. Furthermore, this can advantageously allow a consumer to slide the upstream end of the tube beyond the upstream end of the mouthpiece, when extinguishing the smoking article, without the downstream end of the tube moving upstream of the downstream end of the mouthpiece.

Preferably, the inner diameter of the tube is between about 7.8 mm and about 8.2 mm, between about 6.8 mm and about 7.2 mm, or between about 5.8 mm and about 6.2 mm. The outer diameter of the tube is preferably between about 0.4 mm and 1.0 mm greater than the inner diameter of the tube.

The tube may be formed of any suitable material or materials. In some embodiments, the tube is formed from paper, such as spirally wound paper. This may be advantageous when the tube is intended for a single use. In some other embodiments, the tube can be formed from a plastic or polymeric material, or a metallic material. This may be advantageous when the tube is intended to be reusable.

In some particularly preferred embodiments, the tube comprises a tubular body and a wrapper wrapped around the tubular body. In such embodiments, the tubular body can define the inner surface of the tube, and the wrapper can define the outer surface of the tube. Preferably, the wrapper is made from paper. Preferably, the wrapper is made from tipping paper. For example, the wrapper preferably has a basis weight of between about 25 grams per square metre squared and about 150 grams per square metre, more preferably between about 25 grams per square metre and about 100 grams per square metre. Preferably, the wrapper has a thickness of between 20 micrometres and 250 micrometres, more preferably between 100 micrometres and 200 micrometres. Such an arrangement can advantageously help the outer surface of the tube to exhibit similar properties to the outer surface of a conventional smoking article, whilst also ensuring the tube remains sufficiently rigid and durable for slidable affixment to the mouthpiece of the smoking article.

The tube may be provided with one or more indicia on its inner surface, its outer surface, or both. Alternatively or additionally, a smoking article may be provided with one or more indicia. The term "indicia" is used to refer to a discrete visual element, or repeating visual elements or patterns that provides an aesthetically pleasing or informative representation. The indicia may be in the form of text, images, letters, words, logos, patterns or a combination thereof. For example, the indicia could be used to indicate to a consumer which end of the tube should be the upstream end and which end should be the downstream end. Alternatively or additionally, the indicia could be used to indicate to a consumer that flavourant could be released by application of a force to a specific portion of the tube, or by a specific movement of the tube with respect to a smoking article (such as by rotating the tube around the circumference of the smoking article). Alternatively or additionally, a smoking article may be provided with one or more indicia, wherein each indicia is configured to indicate how a consumer could align the tube relative to the smoking article to provide a desired level of ventilation.

According to a second aspect of the present invention there is provided a smoking article assembly comprising a tube according to the first aspect of the invention affixed to the mouthpiece of the smoking article. The tube may have any of the preferred features described above in respect of the first aspect of the invention. In particular, it is preferable that the tube and the smoking article of the assembly are configured to permit the tube to slide over and around the exterior of the smoking article along the smoking article's entire length. That is, it is preferable for the inner surface of the tube to be continuous, without any distinct steps that would prevent the tube from sliding over and along the entire length of a smoking article.

The smoking article assembly may be provided in an assembled form, in which case the tube is already disposed around and temporarily affixed to the mouthpiece of the smoking article. In this case a consumer can immediately smoke the smoking article, and optionally adjust the location of the tube relative to the mouthpiece as they desire. Alternatively, the smoking article assembly may be provided in an unassembled form, in which case the tube is not yet disposed around and temporarily affixed to the mouthpiece of the smoking article. In this case a consumer can slide the tube over the smoking article mouthpiece to a desired location and then begin to smoke the smoking article. The smoking article assembly may therefore be provided as a kit, preferably with instructions for assembling the kit. Accordingly, according to a third aspect of the present invention, there is provided a kit of component parts capable of being assembled, the kit comprising a smoking article and a tube according to the first aspect of the invention. The component parts capable of being assembled may have any of the preferred features described above in respect of the first aspect of the invention. The component parts of the kit capable of being assembled may additionally comprise instructions for assembling the component parts, a container for containing one or more of the component parts, or both.

The smoking article is preferably a filter cigarette comprising a rod of tobacco cut filler surrounded by a paper wrapper and a cylindrical filter aligned in end-to-end relationship with the wrapped tobacco rod, with the filter attached to the tobacco rod by tipping paper. Preferably, the filter comprises a plug of filtration material wrapped in a plug wrap. The filter cigarette may comprise a multi-component filter that comprises two or more segments of filtration material for the removal of particulate and gaseous components of the mainstream smoke.

Alternatively, the smoking article may be a smoking article in which an aerosol forming substrate, such as tobacco, is heated rather than combusted. In heated smoking articles, the aerosol is generated by heating the aerosol forming substrate. For example, the heated smoking article could include smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer.

According to a fourth aspect of the present invention, there is provided a container containing one or more of the tubes according to the first aspect of the invention. The one or more tubes contained within the container may have any of the preferred features described above in respect of the first aspect of the invention. The container may have any suitable shape or configuration. Preferably, the container is a hinge-lid pack of the type generally used to contain conventional smoking articles. An advantage of such a container is that the one or more tubes can be longitudinally aligned in the container, such that when the lid is opened, the open ends of the tubes are exposed and facing upwards. This can make it easier for a consumer to affix a smoking article to a tube, by simply holding the pack in one hand and inserting the smoking article mouthpiece into an exposed open end of a tube in a pack with the other hand. Accordingly, preferably the tubes are arranged in the container, such that when the container is opened, at least one tube is arranged such that it has an open end that is exposed to the exterior of the container. Preferably, the tubes are axially aligned and held in place within the container.

The container may only contain the tubes as described above. Alternatively, in some embodiments, the container may also contain one or more smoking articles, for which the tubes can be affixed to. These smoking articles may include a mouth end cavity. The tubes may be provided in the container adjacent to a smoking article, in which case a consumer can affix the tube to the mouthpiece of the smoking article when they wish to smoke the smoking article. Alternatively, the one or more tubes may already be affixed to a respective smoking article in the container, such that a consumer can remove the tube and its associated smoking article from the container in a single action.

The invention will be further described, by way of example only, with reference to the accompanying drawings in which.

Figure 1:
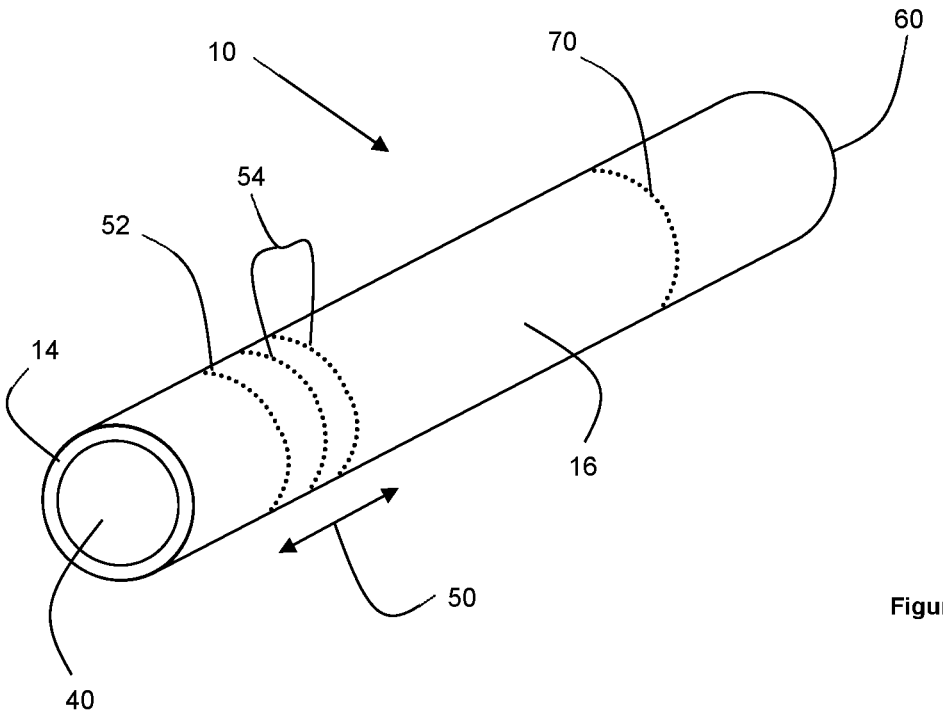
FIG. 1 is a perspective view of a tube for temporary affixment to a smoking article according to an embodiment of the invention.

FIG. 1 shows a tube (10) for temporary affixment to a mouthpiece of a smoking article. The tube (10) has an open downstream end (40) and an open upstream end (60). The tube is hollow and has a lumen extending from the open upstream end (60) to the open downstream end (40) for receiving a mouthpiece of a smoking article. The tube (10) has a first ventilation zone (50) comprising a plurality of lines of ventilation holes (52, 54), in this case three lines. A first line of ventilation holes (52) is provided at a location between 10 mm and 15 mm from the open downstream end (40) of the tube (10).

The tube in FIG. 1 also includes a second ventilation zone having a line of perforation holes (70) at a location between 10 mm and 15 mm from the open upstream end (60) of the tube (10). The tube (10) is formed from a tubular body (14) that defines an inner surface of the tube, and an outer wrapper (16) that defines an outer surface of the tube (10). In the embodiment of FIG. 1, the outer wrapper (16) is preferably a tipping paper.

Figure 2:
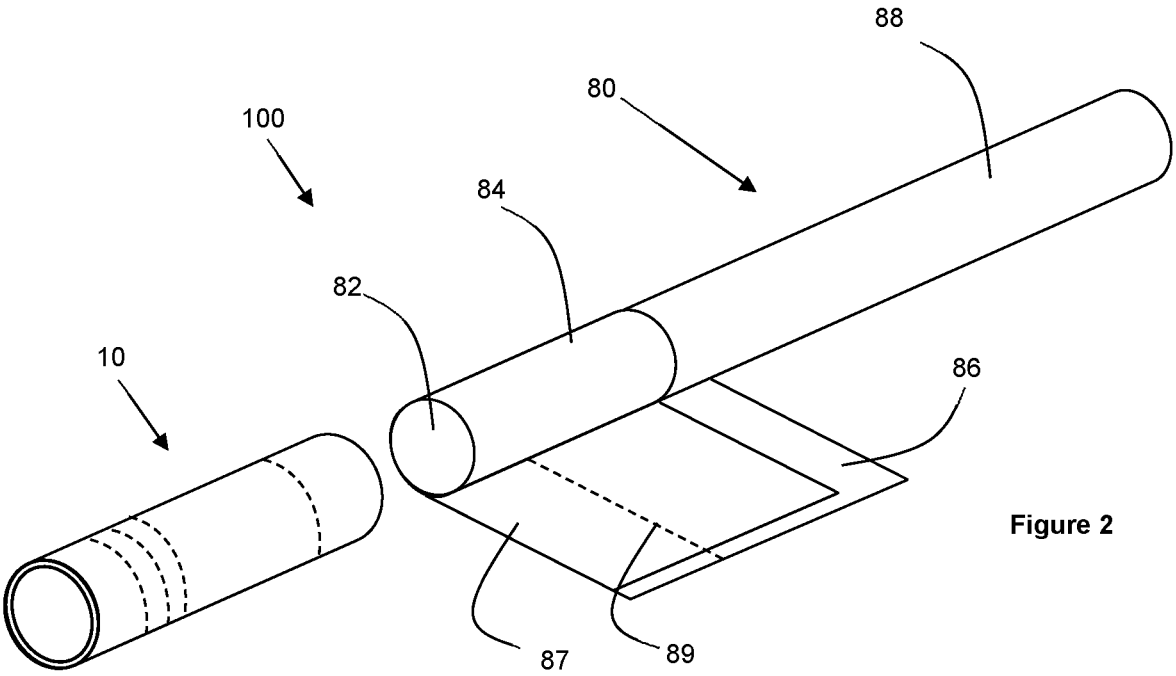
FIG. 2 is a perspective view of a smoking article and the tube of FIG. 1 in an unassembled condition.

FIG. 2 shows the tube (10) of FIG. 1 together with a smoking article (80) in an unassembled condition. The smoking article (80) comprises a tobacco rod (88) and a filter (84) that secured together by a tipping paper (86). The tipping paper (86) and the filter plug wrap (87) are shown in an unassembled condition for clarity. A line of perforation holes (89) is provided on tipping paper (86) and the filter plug wrap (87). The filter (84) has a downstream mouth end (82). As can be seen from FIG. 2, the lumen of the tube (10) is shaped and sized such that tube (1) can slide over and become affixed to the filter (84) of the smoking article (80).

Figure 3:
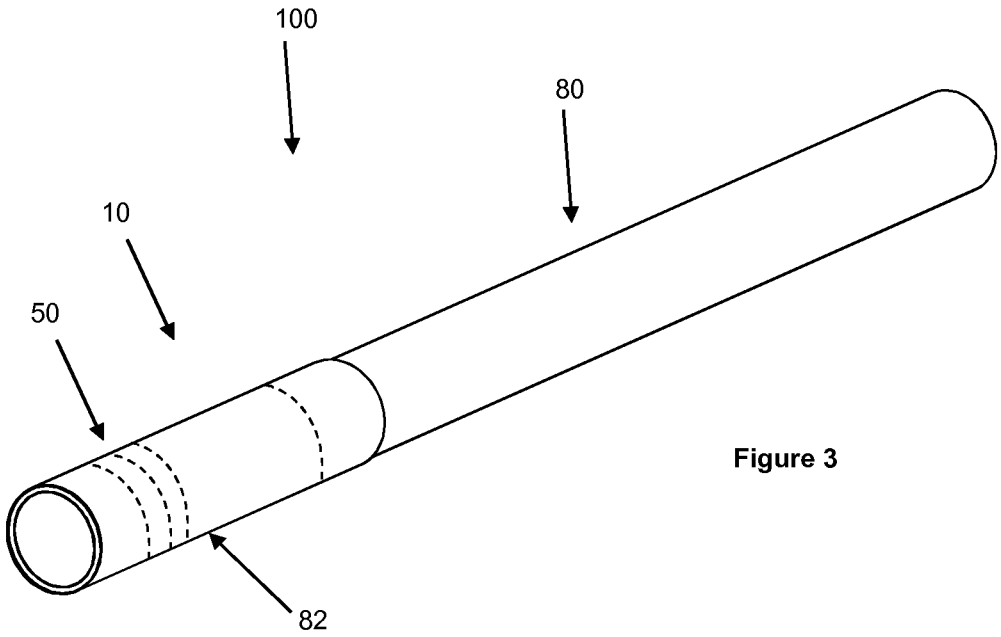
FIG. 3 is a perspective view of a smoking article and the tube of FIG. 1 in an assembled condition.

FIG. 3 shows a configuration (100) in which the tube (10) is affixed to the smoking article (80). Although not visible from this exterior perspective view, the mouth end of the smoking article (82) is located slightly upstream of the first ventilation zone (50) on the tube (10). This arrangement would result in the downstream end of the tube (10) defining a mouth end cavity, and ventilation being provided into the mouth end cavity by the perforation lines (52, 54) of the first ventilation zone (50).

After a consumer has finished smoking the smoking article (80) they can then slide the tube (10) upstream, such that the lit end of the tobacco rod (88) is covered by the upstream end of the tube (10) and thereby extinguished. Any loose tobacco or embers may be retained within the lumen of the tube (10) to minimise the possibility of these coming into contact with a consumer's fingers.

The invention claimed is:

1. A tube for temporary affixment to a mouthpiece of a smoking article, the tube having a length of between about 37 mm and about 60 mm, the tube comprising:

an open upstream end;

an open downstream end;

an outer surface; and an inner surface defining a lumen for receiving the mouthpiece of the smoking article, the lumen extending from the open upstream end to the open downstream end, wherein the tube further comprises a first ventilation zone for providing ventilation into the lumen of the tube, the first ventilation zone comprising a first line of perforation holes extending from the outer surface to the inner surface and circumscribing the tube at a location between 10 mm and 15 mm from the open downstream end of the tube, and a second ventilation zone for providing ventilation into the lumen of the tube, the second ventilation zone comprising a first line of perforation holes circumscribing the tube at a location between 10 mm and 15 mm from the open upstream end of the tube, wherein the first line of perforation holes of the first ventilation zone is configured to provide a different level of ventilation than the first line of perforation holes of the second ventilation zone such that a different level of ventilation may be obtained depending on the orientation the tube is slid over a smoking article, wherein flavourant is provided on the inner surface of the tube, the outer surface of the tube, or both, the flavorant being configured to be released in response to movement of the tube over or around the mouthpiece of the smoking article, and wherein the tube is configured to slide over the entire length of a smoking article.

2. A tube according to claim 1, wherein the first ventilation zone further comprises one or more additional lines of perforation holes circumscribing the tube at a location between 12 mm and 30 mm from the open downstream end of the tube.

3. A tube according to claim 1, wherein the second ventilation zone further comprises one or more additional lines of perforation holes circumscribing the tube at a location between 12 mm and 30 mm from the open upstream end of the tube.

4. A tube according to claim 1, wherein the outer surface of the tube, the inner surface of the tube, or both, are provided with one or more indicia for indicating the location of the first line of perforation holes of the first ventilation zone.

5. A tube according to claim 2, wherein the outer surface of the tube, the inner surface of the tube, or both, are provided with one or more indicia, wherein each indicia is configured to indicate the location of a respective line of perforation holes on the tube.

6. A tube according to claim 1, wherein the outer diameter of the tube at the open upstream end is at least about 90 percent of the outer diameter of the tube at the open downstream end, wherein the inner diameter of the tube at the open upstream end is at least about 90 percent of the inner diameter of the tube at the open downstream end, or both.

7. A tube according to claim 1, wherein the tube further comprises a tubular body and a wrapper wrapped around the tubular body.

8. A smoking article assembly comprising a tube according to claim 1 affixed to the mouthpiece of a smoking article.

9. A kit of component parts capable of being assembled, the kit comprising a smoking article and a tube according to claim 1.

10. A container containing one or more of tubes according to claim 1.

* * * * *